US007311815B2

(12) United States Patent
Abazajian

(10) Patent No.: US 7,311,815 B2
(45) Date of Patent: Dec. 25, 2007

(54) HYDROCARBON PRODUCTS AND METHODS OF PREPARING HYDROCARBON PRODUCTS

(75) Inventor: Armen N. Abazajian, Houston, TX (US)

(73) Assignee: Syntroleum Corporation, Tulsa, OK (US)

( * ) Notice: Subject to any disclaimer, the term of this patent is extended or adjusted under 35 U.S.C. 154(b) by 439 days.

(21) Appl. No.: 10/427,508

(22) Filed: Apr. 30, 2003

(65) Prior Publication Data

US 2004/0164000 A1 Aug. 26, 2004

Related U.S. Application Data

(60) Provisional application No. 60/448,586, filed on Feb. 20, 2003.

(51) Int. Cl.
*C10G 45/00* (2006.01)

(52) U.S. Cl. ..... 208/143; 208/79; 208/111; 208/112; 208/307; 252/558; 260/501; 260/501.21; 260/505 N; 260/505 R; 260/505 S; 260/512 R; 260/621; 260/621 R; 260/645; 518/703; 562/93; 585/317; 585/319; 585/323; 585/448; 585/455; 585/733; 585/740

(58) Field of Classification Search ..... 208/79, 208/111, 112, 307, 143; 252/558; 260/501, 260/501.21, 505 N, 505 R, 505 S, 621, 621 R, 260/645, 512 R; 518/703; 562/93; 585/317, 585/319, 323, 448, 455, 740, 750, 751
See application file for complete search history.

(56) References Cited

U.S. PATENT DOCUMENTS 3,681,442 A 8/1972 Bloch et al.
3,910,994 A 10/1975 Bloch et al.
5,276,231 A 1/1994 Kocal et al.
5,292,983 A * 3/1994 Sie ..... 585/733
5,466,364 A * 11/1995 Kaul et al. ..... 208/307
5,689,031 A 11/1997 Berlowitz et al.
5,766,274 A 6/1998 Wittenbrink et al.
5,833,839 A * 11/1998 Wittenbrink et al. ..... 208/112
5,866,748 A 2/1999 Wittenbrink et al.

(Continued)

FOREIGN PATENT DOCUMENTS

AU 711333 B2 7/1997

(Continued)

OTHER PUBLICATIONS

L. Cavalli, et al., Iso-Branching of Linear Alkylbenzene Sulphonate (LAS), UMWELT/Environment, No Date., pp. 1-6.

(Continued)

*Primary Examiner*—Glenn Caldarola
*Assistant Examiner*—Prem C. Singh
(74) *Attorney, Agent, or Firm*—Baker & McKenzie LLP

(57) ABSTRACT

A method of preparing high linear paraffin or high end-chain monomethyl content products is accomplished by converting synthesis gas in a Fischer-Tropsch reaction to hydrocarbon products. These may be hydrotreated to provide an n-paraffin content of greater than 50% by weight, with substantially all branched paraffins being monomethyl end-chain branched paraffins. At least one non-linear paraffin isomer, which may be a monomethyl paraffin isomer, may be separated from the hydrocarbon products through distillation to provide an n-paraffin product having an n-paraffin content percentage by weight of the n-paraffin product that is greater than the initial n-paraffin content.

11 Claims, 1 Drawing Sheet

U.S. PATENT DOCUMENTS

| | | | | |
|---|---|---|---|---|
| 5,906,727 | A | 5/1999 | Wittenbrink et al. | |
| 6,130,259 | A * | 10/2000 | Waycuilis | 518/703 |
| 6,187,981 | B1 | 2/2001 | Marinangeli et al. | |
| 6,392,109 | B1 | 5/2002 | O'Rear et al. | |
| 6,475,960 | B1 | 11/2002 | Berlowitz et al. | |

FOREIGN PATENT DOCUMENTS

| | | | |
|---|---|---|---|
| WO | WO 99/05082 | A1 | 2/1999 |
| WO | WO 01/02325 | A1 | 1/2001 |

OTHER PUBLICATIONS

UOP Linear Alkylbenzene (LAB) Complex, Olefins and Derivatives, UOP LLC, 2001, pp. 1-2.

Web Pages from Iran Chemical Industries, We are the First and Only Producer of Linear Alkyl Benzene (LAB) in Iran, www.neda.net/iciiclab/product.html, Jul. 1, 2002, p. 1.

J. Burkett St. Laurent, D. Connor, T Cripe, et al., Improved Alkyl Benzene Surfactants Molecular Design and Solution Physical Chemical Properties, The Proctor & Gamble Co., presented at CESIO World Surfactants Congress 2001, pp. 1-9.

L. Cavalli, et al., Iso-Branching of Linear Alkylbenzene Sulphonate (LAS), Biodegradation Study of Two Model Compounds, Toxicology and Environmental Chemistry, vol. 54, 1996 pp. 167-186.

Anionic Surfactants, Organic Chemistry, Edited by Helmut W. Stache, Huls AG, Mari, Germany, Marcel Dekker, Inc., pp. 106-143, 1995.

B. V. Vora, et al., Production of Biodegradable Detergent Intermediates, CESIO, 2nd World Surfactants Congress, May 24-27, 1988, pp. 176-189, ASPA, Paris.

A.M. Nielson, et al., Biodegradation of Coproducts of Commercial Linear Alkylbenzene Sulfonate; Environ. Sci. Technol, 1997, pp. 3397-3404, vol. 31.

P.R. Pujado, Linear Alkybenzene (LAB) Manufacture, Handbook of Petroleum Refining Processes, Robert A. Mayers, Editor, 2nd Ed., pp. 1.53-1.66, McGraw-Hill, 2003.

Web pages from Ecosol website, www.ecosol.com, No Date—at least as early as Apr. 29, 2003, pp. 1-57.

* cited by examiner

HYDROCARBON PRODUCTS AND METHODS OF PREPARING HYDROCARBON PRODUCTS

This application claims the benefit of U.S. Provisional Application Ser. No. 60/448,586, filed Feb. 20, 2003.

TECHNICAL FIELD

The invention relates generally to hydrocarbon products and methods of preparing hydrocarbon products.

BACKGROUND

Naturally occurring petroleum may be made up of a variety of different hydrocarbon substances. These may include paraffinic, isoparaffinic, cycloparaffinic and aromatic hydrocarbons, and may range from light gases to kerosene to heavy asphalts.

Linear paraffins from petroleum are often used in forming detergents or surfactants. Linear paraffins, typically in the $C_{10}$ to $C_{24}$ range, may be alkylated with benzene directly or after undergoing dehydrogenation to form alkylbenzene, which is then sulfonated to form alkylbenzene sulfonate detergents. Because petroleum-derived paraffins may be highly branched, having one or more branches of different lengths that may be randomly positioned along the main carbon chain, it is difficult to isolate linear paraffins from the mixture to achieve high linear purity. Additionally, branched-chain alkylbenzene sulfonates, while providing good detergency or surfactancy, are not easily biodegraded. Because of increasing environmental concerns, there has been an emphasis on producing high purity linear alkylbenzene (LAB) feedstock for use in making linear alkylbenzene sulfonate (LAS), which is readily biodegraded.

In the manufacture of LAS, linear purities for the paraffin feedstock may be as much as 95% and even 98% or more by weight of the paraffin feedstock. Petroleum derived hydrotreated distillates containing the appropriate carbon number hydrocarbons or paraffins typically only have a linear content of from 40% or lower by weight. Thus, procedures for purifying linear paraffins are needed. Because conventional hydrotreated distillates usually include relatively large amounts of various cyclic or branched paraffin components, separating the linear paraffins from non-linear paraffins is impossible using distillation separation techniques. This is due to the large degree of overlap in the boiling points of the non-linear paraffin components with those of the linear paraffins. Therefore, separation of the linear paraffins is usually carried out using shape-selective molecular sieve separation. Molecular sieve separation is quite involved and requires the use of costly molecular sieve adsorbents and equipment. Separation of linear paraffins from non-linear paraffins using urea adduction techniques have also been employed, but are less efficient and are not widely practiced commercially.

BRIEF DESCRIPTION OF THE DRAWINGS

For a more complete understanding of the present invention, and the advantages thereof, reference is now made to the following descriptions taken in conjunction with the accompanying figures, in which.

DETAILED DESCRIPTION

Figure 1:
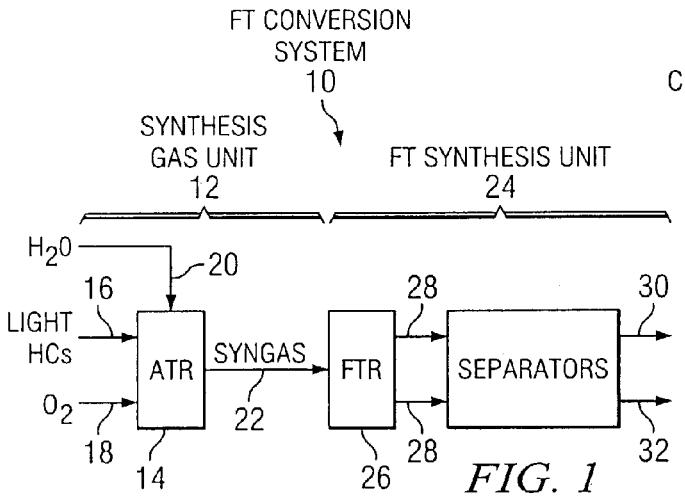
FIG. 1 is a schematic flow diagram of a Fischer-Tropsch hydrocarbon conversion system.

The synthetic production of hydrocarbons by the catalytic reaction of synthesis gas is well known and is generally referred to as the Fischer-Tropsch ("F-T") reaction. The Fischer-Tropsch process was developed in the early part of the $20^{th}$ century in Germany and was practiced commercially in Germany during World War II and later in South Africa and Malaysia.

Fischer-Tropsch hydrocarbon conversion systems typically have a synthesis gas ("syngas") generator and a Fischer-Tropsch reactor unit. The synthesis gas generator receives light or short-chain hydrocarbons, such as methane and produces the synthesis gas. The synthesis gas may be made from natural gas, gasified coal, and other sources of light or short-chain hydrocarbons. The synthesis gas is then delivered to a Fischer-Tropsch reactor. In the F-T reactor, the synthesis gas is converted to heavier, longer-chain hydrocarbons.

Three basic techniques may be employed for producing the synthesis gas. These include oxidation, reforming and autothermal reforming. As an example, FIG. 1 generally shows a F-T conversion system 10 for converting hydrocarbon gases to liquid or solid hydrocarbon products using autothermal reforming. The conversion system 10 includes a synthesis gas unit 12, which may be configured in a number of different ways, but in the embodiment shown, the unit 12 includes a synthesis gas reactor 14 in the form of an autothermal reforming reactor (ATR) containing a reforming catalyst, such as a nickel-containing catalyst. A stream of light hydrocarbons 16 to be converted, which may include natural gas, is introduced into the reactor 14 along with oxygen ($O_2$) 18. The oxygen may be provided from compressed air, oxygen-enriched air or other compressed oxygen-containing gas, or may be a pure oxygen stream. For the process shown, an air-blown system is used. Steam 20 may also be introduced into the ATR 14. The ATR reaction may be adiabatic, with no heat being added or removed from the reactor other than from the feeds and the heat of reaction. The reaction is carried out under sub-stoichiometric conditions whereby the oxygen/steam/gas mixture is converted to syngas 22. Examples of Fischer-Tropsch systems are described in U.S. Pat. Nos. 4,883,170; 4,973,453; 5,733,941; 5,861,441; 6,130,259; 6,169,120; 6,172,124, 6,239,184, 6,277,338, 6,277,894 and 6,344,491, all of which are herein incorporated by reference.

The Fischer-Tropsch reaction for converting synthesis gas or syngas, which is composed primarily of carbon monoxide (CO) and hydrogen gas ($H_2$) may be characterized by the following general reaction:

$$2nH_2+nCO \rightarrow (-CH_2-)_n+nH_2O \quad (1)$$

Non-reactive components, such as nitrogen, may also be included or mixed with the syngas. This may occur in those instances where air or some other non-pure oxygen source is used during the syngas formation, such as those previously referenced. In such systems, the syngas fed to the Fischer-Tropsch reactor (FTR) may have from about 10 to about 60% by volume of nitrogen.

The hydrocarbon products derived from the Fischer-Tropsch reaction may range from methane ($CH_4$) to high molecular weight paraffinic waxes containing more than 100 carbon atoms.

Referring again to FIG. 1, the syngas is delivered via line 22 to a synthesis unit 24, which includes an FTR 26 containing a Fischer-Tropsch catalyst. Numerous Fischer-Tropsch catalysts may be used in carrying out the reaction. These include cobalt, iron, ruthenium as well as other Group VIIIB transition metals or combinations of such metals, to prepare both saturated and unsaturated hydrocarbons. For purposes of this invention, a non-iron catalyst may be used. The F-T catalyst may include a support, such as a metal-oxide support, including silica, alumina, silica-alumina or titanium oxides. An example of such a catalyst may be a Co catalyst on transition alumina, with the surface area of approximately 100-200 $m^2/g$ that is in the form of spheres 50-150 nm in diameter. Co concentration on support may be 15-30% by weight. Certain catalyst promoters and stabilizers may be used. The stabilizers may include Group IIA or Group IIIB metals, while the promoters may include Group VIII or Group VIIB. The Fischer-Tropsch catalyst and reaction conditions may be selected to be optimal for desired reaction products, such as for hydrocarbons of certain chain lengths or number of carbon atoms. Any of the following reactor configurations may be employed for F-T synthesis: fixed bed, slurry reactor, ebullating bed, fluidized bed, or continuously stirred tank reactor (CSTR). In the example shown, a slurry bed reactor is used. The F-T reactor may be operated at a pressure of 100 to 500 psia and a temperature of 190° F. to 500° F. The reactor GHSV may be from 1000 to 8000 $hr^{-1}$. Syngas in line 22, containing gaseous hydrocarbons, hydrogen, carbon monoxide and nitrogen, with $H_2/CO$ ratios from 1.8 to 2.4, is contacted with the catalyst under the reaction conditions described above.

The F-T hydrocarbon reaction products 28 may be further processed or separated. For example, the resultant F-T hydrocarbon reaction products may be separated or otherwise fractionated to remove lighter and heavier hydrocarbons 30, 32 from one another to facilitate further processing or to separate them into desired products. This may be done through conventional fractional distillation techniques, which are well within the knowledge of those skilled in the art, wherein lower boiling point hydrocarbon fractions are separated from higher boiling point hydrocarbon fractions.

F-T synthesis may result in a wide variety of different hydrocarbon products. Non-limiting examples may include:

1) Chemical naphtha for high-yield ethylene cracking (typically $C_5$ to $C_9$ range);
2) Fuel cell feedstocks (typically $C_4$-$C_9$ range);
3) Normal paraffin solvents and chemical feedstocks (typically $C_5$-$C_{30}$ range);
4) Isoparaffin solvents and chemical feedstocks (typically $C_5$-$C_{30}$ range);
5) Normal paraffin and isoparaffin drilling fluids (typically $C_8$-$C_{25}$ range);
6) Food grade solvents and base oils (typically $C_5$-$C_{60}$ range); and
7) Solvents, base-oils and functional fluids in applications requiring extreme non-reactivity or purity, such as for electronics applications (typically $C_5$-$C_{60}$ range).

Although synthetic hydrocarbons produced from the Fischer-Tropsch reaction may resemble many of those derived from petroleum, it has been observed that the F-T hydrocarbon reaction products have a high degree of linearity when compared to naturally occurring mineral or petroleum-derived hydrocarbons. As used herein, unless otherwise specified, the terms "linear" or "linearity" refer to straight-chain hydrocarbons without any carbon-atom branching. This is particularly true with respect to the paraffinic hydrocarbons. F-T hydrocarbon reaction products, particularly in the middle distillate range, have a linearity that may be greater than 50%, 60%, 70%, 80% and 90% by weight or more. It should be noted that all percentages used herein are based on weight, unless otherwise specified. F-T hydrocarbon reaction products also contain very little, much less than 1% by weight, aromatic or cyclic hydrocarbons, in contrast to petroleum.

Furthermore, it has been observed that F-T produced hydrocarbons, if non-linear, are typically only lightly branched. These may be single, short branches, which may be predominantly monomethyl branches. It has been observed that paraffins of $C_6$ or greater, the monomethyl branches may be located at a terminal or end-chain position. As used herein, the terms "terminal" or "end-chain" when referring to branch attachment shall be construed as being either the 2- or 3-carbon position of the main carbon chain. The monomethyl isomers also tend to be more volatile than the linear chain hydrocarbons. Typically, differences in normal boiling points between the monomethyl and linear isomers are from about 2 to about 15° F. Because of the relatively low concentration of the branched isomers and the relatively few species of such isomers being present, such isomers may be removed by distillation, as is described further on, to provide a higher purity linear hydrocarbon or paraffin products. Increasing the linear purity may be accomplished through the removal of all or a portion such non-linear isomers of a given carbon number, or non-linear isomers of more than one carbon number may be removed. The terminal or end-chain branched monomethyl isomers from F-T produced hydrocarbons, at least in the middle distillate range, typically make up from 50% to about 70% by total weight of monomethyl isomers.

Because of the high linearity and limited and terminal branching, F-T produced paraffins may have particular application in producing linear alkylbenzene (LAB) and/or modified-linear alkylbenzene (MLAB). As used herein, "modified-linear" shall be construed to mean monomethyl-branched, or mixture of linear and monomethyl-branched isomers, with a significant portion of monomethyl species. Additionally, it should be noted that although specific reference is made herein to alkylbenzene or alkylbenzenes, the invention may have application to other alkylaromatics, including the monocycloaromatics benzene, toluene, aniline and substituted aniline, phenol and substituted phenols, as well as maleic anhydrides, succinic anhydrides, and also cyclopentadiene, dicyclopentadiene and substituted cyclopentadiene and dicyclopentadiene and similar products or compounds.

Also, because of the high linearity and limited terminal branching, F-T produced paraffins may have particular application in producing other surfactants, such as alcohols, amines, alpha-olefins, and paraffin sulfonates.

Alkylaromatics may be made into alkylaromatic sulfonates used as surfactants. These are usually prepared from alkyl chains of from 6 to 24 carbon atoms. Alkyl chains in alkylaromatic surfactants used in water-soluble detergents, including household and laundry detergents, are, more commonly, from 8 to 16 carbon atoms, 9 to 14 carbon atoms, and still more commonly from 10 to 13 carbon atoms. Alkylaromatic surfactants used in oil-soluble detergents, including lubricant and fuel detergents, have an alkyl chain length that is more commonly from 10 to 30 carbon atoms, 12 to 26 carbon atoms, and still more commonly from 14 to 24 carbon atoms. It should be noted that the terms "LAB" or "LAS," when referred to generally as products, may include some amounts of non-linear alkylbenzene or non-linear alkylbenzene sulfonates that are present as impurities. Likewise, reference to MLAB or modified-linear alkylbenzene sulfonates (MLAS), may include some larger amounts of linear alkylbenzene or linear alkylbenzene sulfonates.

As discussed previously, LAS are commonly used in detergents today because of their biodegradability, as compared to branched alkyl benzene sulfonates (BABS), which are highly branched and are made from propylene tetramer and benzene. Furthermore, the push for higher biodegradability of petroleum-based LAS has resulted in continued increases in linearity of LAS and in linearity of the n-paraffin feedstocks. Typically, the biodegradability of LAS ranges from 80% to about 99% as measured pursuant to ASTM D2667-95 (2001) or OECD 303 A. In general, branched alkylbenzene sulfonates do not tend to biodegrade well, with more branching tending to reduce the biodegradability of the detergent. As a result, with today's environmental concerns, the industry trend has been to reduce the amount of branched alkylbenzene sulfonates present in detergents and detergent-containing products. Thus, linear alkylbenzene is used commercially. The linear alkylbenzene content of LAB used in making LAS products is typically at least 90% by total weight or greater, with at least 95% by total weight becoming more common.

Figure 2:
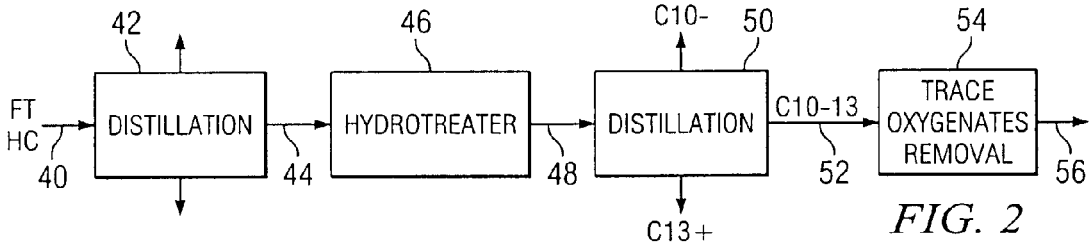
FIG. 2 is a schematic flow diagram of a system for processing Fischer-Tropsch hydrocarbon products used in producing high purity linear hydrocarbons.

For purposes of illustration, a flow diagram for a process for processing FT-hydrocarbon products to produce $C_{10}$ to $C_{13}$ paraffin product is shown in FIG. 2. It should be apparent to those skilled in the art that other products of different carbon chain length or with a narrower or broader carbon chain range could also be processed in a similar manner. Thus, although the process shown is for a carbon chain range of four (i.e. $C_{10}$ to $C_{13}$), the process could have application to a carbon chain range of 3, 5, 6, 7, etc. The process could also have application, for example, to hydrocarbons in the $C_6$ to $C_{10}$ range or from $C_{14}$ to $C_{18}$ range, etc. Also, it should be apparent to those skilled in the art that the elimination of certain steps or procedures described herein or the addition of steps or procedures that are not described may be appropriate depending upon the desired product or objective to be achieved.

The F-T hydrocarbon reaction products 40, such as those in the product stream 28 of FIG. 1 previously described, are introduced into one or more distillation columns 42 for separation into selected or desired fractions. A typical composition of F-T hydrocarbon reaction products is given in Table 1 below.

TABLE 1

| Component | % by weight |
|---|---|
| $C_4$ | 0.1–3 |
| $C_5$ | 0.1–4 |
| $C_6$ | 0.5–6 |
| $C_7$ | 2–20 |
| $C_8$ | 3–30 |
| $C_9$ | 3–35 |
| $C_{10}$ | 2–25 |
| $C_{11}$ | 1–20 |
| $C_{12}$ | 1–20 |
| $C_{13}$ | 0.5–20 |
| $C_{14}$ | 0.5–12 |
| $C_{15}$ | 0.5–15 |
| $C_{16}$ | 0.5–15 |
| $C_{17}$ | 0.5–15 |
| $C_{18}$ | 0.5–15 |

TABLE 1-continued

| Component | % by weight |
|---|---|
| $C_{19}$ | 0.5–12 |
| $C_{20}$ | 0.5–10 |
| $C_{21}$ | 0.5–10 |
| $C_{22}$ | 0.5–7 |
| $C_{23+}$ | 5–60 |

The carbon number distribution presented in Table 1 can be further broken down into paraffins (20-95%), isoparaffins (2-50%), olefins (0-70%), alcohols 0-30% and other oxygenates (0-20%).

In this example, products with normal boiling points of 300° F. + are removed from the distillation column 42 and are delivered via 44 to a hydrotreating reactor 46. The products may include a kerosene fraction, which may have components with normal boiling points ranging from about 300° F. to about 600° F., and which may include the $C_9$ to $C_{19}$ paraffins. Other broader or narrower ranging boiling point fractions may be separated as well, which may contain shorter or longer carbon chain paraffins.

Hydrotreatment of the F-T hydrocarbon reaction products may be carried out to saturate unsaturated hydrocarbons and/or remove undesirable components, such as polar compounds of oxygen, nitrogen, sulfur and metals. The F-T hydrocarbons usually include oxygenates of from 0.1% to 30% or more by weight, more typically from about 2% to about 15% by weight. Hydrotreatment facilitates the conversion of many such oxygen-containing hydrocarbons to paraffins. The hydrotreatment may be carried out at a pressure of 500-2000 psig, and a temperature of from 300 to 700° F. over a noble metal catalyst that may be impregnated on an alumina, silica alumina or zeolite, or a transition-metal catalyst including, but not limited to, nickel, cobalt and mixtures thereof with other metals. It may be carried out with or without passing through a molecular sieve catalyst.

After hydrotreating, the hydrotreated compounds 48 may be introduced into a distillation column 50 to remove a $C_{10}$ to $C_{13}$ fraction 52. The distillation is accomplished at 10-50 psia pressure, with bottoms temperature at approximately 400 to 600F. The $C_{10}$ to $C_{13}$ fraction may be removed as a side stream to meet $C_9$ and lighter and $C_{14}$ specifications in the $C_{10-13}$ fraction, but also to remove branched $C_{10}$, which has a lower boiling point than n-paraffin $C_{10}$, distilled overhead with considerable amount of n-paraffin $C_{10}$. Sufficient stages of separation and a high reflux ratio may be used to drive off $C_{10}$ isomers preferentially to $C_{10}$ paraffin. Also, to limit the contribution of $C_{14}$, mostly $C_{14}$ isomers, to the $C_{10}$-$C_{13}$ cut, the $C_{10}$ to $C_{13}$ fraction may be removed as a side stream, with some $C_{10}$ and $C_{13}$ being removed in the overheads and bottoms, respectively. This assures the removal of $C_{10}$ branched isomers and $C_{14}$ linear and non-linear isomers from the product stream 52, as well as increases the linearity of the $C_{10}$ to $C_{13}$ fraction 52. The amount of each of $C_{10}$ through $C_{13}$ carbon numbers in the side stream 52 may vary, but a typical range may be from about 2 to about 40% by weight. The $C_{10}$ to $C_{13}$ fraction 52 may then be introduced into an oxygenate removal unit 54 to remove any remaining oxygenates, if necessary. As used herein, the expression "oxygenate" is to be construed to mean an organic oxygen-containing compound.

While the predominate oxygenate in FT crude are the primary linear alcohols, it has been found that there may also be small amounts of carboxylates in the crude F-T hydrocarbons. These carboxylates may include aldehydes, ketones and carboxylic acids. Typically, such compounds may initially be present in an amount of up to 200 to 300 ppm by weight or more. Unless otherwise indicated, all ppm values presented herein are based on weight.

Although conventional hydrotreatment of FT hydrocarbon products may remove oxygenates, it has been found that some amount of oxygenates, for example 5-500 ppm, more particularly from 50 to 300 ppm, may remain after such treatment. Residual oxygenates after the treatment are typically alcohols, aldehydes, ketones, and carboxylic acids, with unsaturated species (aldehydes, ketones, acids) representing a much higher portion of the oxygenates than before such treatments. In particular, the non-alcohol or unsaturated species of oxygenates may make up greater than 20%, 40%, 60%, 80% or more by weight of the oxygenates. These oxygenated impurities may be detrimental to the performance of n-paraffins and other FT-based products, which are used in applications requiring purity or non-reactivity of material.

To remove these residual oxygenates, the hydrotreated FT product stream may be preheated to approximately 20 to 100° C. and fed into a bed of alumina, silica, or silica alumina, molecular sieves, clays, rare earths, or bauxites. Examples of such molecular sieves include UOP mol sieves HPG-429 and MRG-E. A reactor LHSV of 1-10 $h^{-1}$ can be used. The molecular sieve adsorbent retains the polar oxygenated species on its surface due to partial positively charged Al and Si sites on the surface of the adsorbent, attracting the polar oxygenated compounds. The paraffins and olefins contained in the product are relatively non-polar and pass through the bed. The adsorbent may have a capacity to adsorb the oxygenates in amounts of from 5-40% or more by weight. The effluent of the bed contains essentially no oxygenates until all of the available sites on the adsorbent surface are saturated, and the oxygenates break through the bed.

Figure 4:
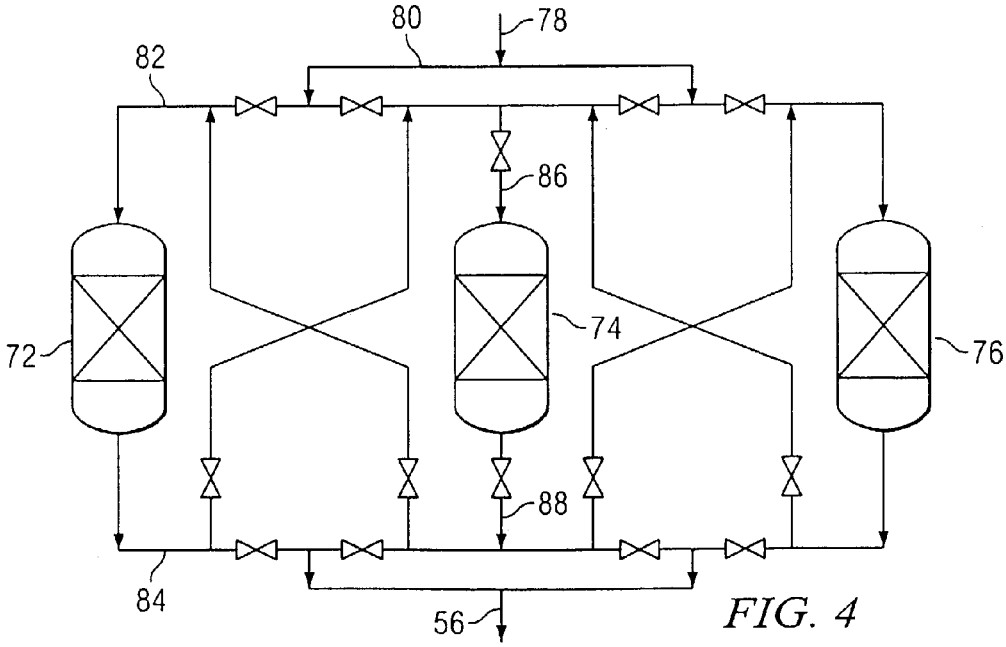
FIG. 4 is a schematic flow diagram of a system for removal of oxygenates.

In terms of a practical design, two or more beds may be used. In one example, three beds 72, 74, 76 may be used, as shown in FIG. 4, with two operating in series, such as bed 72 and 74, and the third bed 76 either being repacked with fresh adsorbent, or undergoing regeneration of adsorbent to free up the adsorbent sites for the next cycle. By way of example, feed 78 is initially introduced into line 80 where it passes through line 82 to the lead bed 72. The effluent 84 from bed 72 is then directed to inlet 86 of second bed 74. The effluent 84 of the first, lead bed 72, may be tested for oxygenates. When oxygenates breaking through the first bed 72 are detected, the first bed 72 is put off-line and the second bed 74 becomes the lead bed, with effluent 88 from bed 74 being fed to bed 76, which is put on line and becomes the lag bed. By alternating and switching the flow between the beds in this manner, the product storage, or the process downstream of the beds are protected from contamination by the presence of a fresh bed between it and the bed being saturated with oxygenates. The saturated beds may be regenerated with hot nitrogen or natural gas at a suitable temperature to vaporize oxygenates and strip them off the adsorbent. A suitable temperature has been found to be from about 200 to about 400° C.

The deoxygenated $C_{10}$ to $C_{13}$ stream 56 can then be fed to a dehydrogenation reactor for the formation of olefins for downstream reaction to alkylaromatics or to other products.

Figure 3:
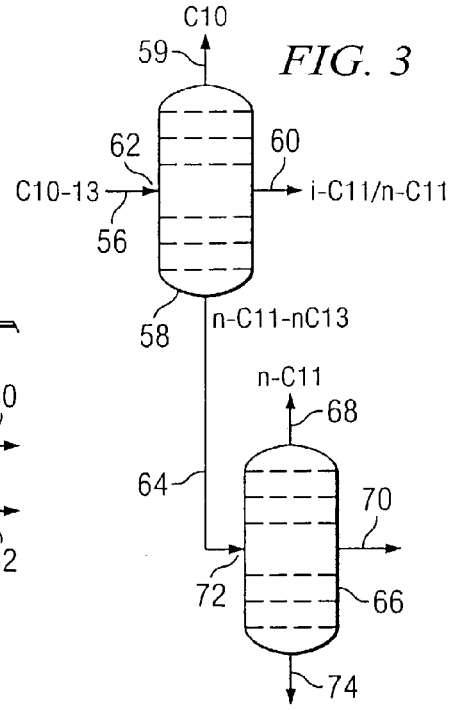
FIG. 3 is a schematic flow diagram of a series of distillation columns for providing high purity linear hydrocarbons.

Alternatively, if increased linearity of the paraffin product is desired, the deoxygenated $C_{10}$ to $C_{13}$ stream 56 may be fed to a series of distillation columns, as shown in FIG. 3. As shown, the product 56 is feed into a first distillation column 58 under temperature and pressure conditions to provide an overheads product stream 59 of $C_{10}$, which may include normal $C_{10}$ paraffins and remaining non-linear or monomethyl $C_{10}$ paraffin isomers. As used in this description, the terms "isomer" or "iso-," unless otherwise indicated, refer to the non-linear paraffin isomers, which are predominately the monomethyl paraffin isomers. An iso-$C_{11}$ product stream is removed as a side stream 60. Sidestream 60 may be either below or above the feed point 62 of column 58. The location of the side stream 60 above or below the feed point may be optimized based on the initial composition of the product 56 and the desired composition of the side stream 60. For the process shown, the side stream 60 is removed above the feed point 62. This side stream 60 may contain substantial amounts of normal $C_{11}$ and normal $C_{10}$ to ensure that substantially all of the monomethyl $C_{11}$ isomer, which is more volatile, is removed. Thus, the side stream 60 may contain a target monomethyl $C_{11}$ isomer content of from about 20 to 80% by weight, with the remainder being normal $C_{11}$ and normal $C_{10}$. In certain cases, less than all or a portion of the monomethyl isomers of the same carbon number may be removed, while still resulting in increased linear purity of n-$C_{11}$ fraction.

The bottoms 64 from distillation column 58 contain n-$C_{11}$ to $C_{13}$. This is fed to a second distillation column 66. The column 66 is operated at pressure and temperature conditions to remove normal $C_{11}$ as overheads 68. An iso-$C_{12}$ product stream is removed as a side stream 70 from either below or above the feed point 72 of column 66 similarly to column 58. This side stream 70 may contain substantial amounts of normal $C_{12}$ and normal $C_{11}$ to ensure that substantially all of the monomethyl $C_{12}$ isomer is removed. A target of $C_{12}$ isomer removed in the side stream 70 may range from about 20 to 80% by weight. In certain cases, less than all or a portion of the monomethyl $C_{12}$ isomer may be removed while still resulting in increased linear purity. A bottoms 74 of normal $C_{12}$ and $C_{13}$ paraffins is removed from the column 66.

Both columns 58 and 66 may be operated with a high feed point, having relatively fewer trays between the overhead and feed tray, and more trays between the bottoms and the side stream. This is done because the enrichment of iso-$C_{11}$ or iso-$C_{12}$ in the sidestream and its removal from n-$C_{11}$ or $C_{12}$, correspondingly, is difficult and requires many stages of vapor-liquid equilibrium. An example of suitable operating conditions for the columns 58 and 66 operating at atmospheric conditions include a temperature profile of 300 to 500 between the top and bottom of the column, with a pressure range of from −5 to 20 psig. It should be apparent to those skilled in the art that variations in the distillation methods could be used as well, such as number and height of the columns, number of trays, variations in feed point and side stream removal, operating pressure and temperatures, etc.

The $C_{10}$ overheads 59, the n-$C_{11}$ overheads 68 and bottoms 74 containing n-$C_{12}$ and $C_{13}$ may be combined to form a high purity linear $C_{10}$ to $C_{13}$ product stream. Thus, for example, a fraction of $C_{10}$ to $C_{13}$ containing 94% by weight linear paraffins and containing 1.5% by weight of iso-$C_{11}$ and 1.5% by weight iso-$C_{12}$, which are removed as side streams containing of about 50% by weight of the isomer, will result in a product stream having a linear purity of approximately 97.9% when the streams are combined. Higher purity linear paraffin may be obtained by increasing the concentration of isomer removed in the side streams. Additional distillation columns could also be used to remove the iso-$C_{13}$ in a similar manner as described. Alternatively, a similar 2-column scheme may be used for removal of iso-$C_{13}$ and iso-$C_{12}$, rather than iso-$C_{11}$ and iso-$C_{12}$. Although this may result in somewhat higher distillation equipment costs, there may be benefits to removing the higher molecular weight isomers as they may be generally less biodegradable than the lower molecular weight isomers.

Although the above-description is with reference to treatment of a $C_{10}$ to $C_{13}$ paraffin product to increase its linear purity, other paraffins of lower or higher carbon number, from $C_6$ to $C_{24}$, could be treated in a similar manner as well. Additionally, a broader or narrower range of paraffins could be treated in a similar fashion.

Either the F-T paraffins prior to isomeric distillation or the high linearity F-T paraffin products after the distillation may be used in the manufacture of linear alkylaromatic compounds, particularly LAB. The alkylaromatics or LAB made from the higher linearity n-paraffins may then be derivatized into alkylaromatic sulfonates or LAS of increased biodegradability. The alkylaromatics or LAB made from the n-paraffins prior to distillation may then be derivatized into alkylaromatic sulfonates or LAS of currently acceptable biodegradability. Alkylation of benzene or other aromatics is well known in the art. Conventional methods include a multi-step process wherein paraffins are first partially dehydrogenated over noble metal catalyst impregnated on a substrate, such as UOP's Pacol™ process. The partially dehydrogenated stream is then hydrogenated selectively to remove dienes formed during dehydrogenation. An example of such technology is UOP's Define™ process. Alkylation, such as practiced in UOP's Detal™, process may result in the degradation of the linear alkyl content by as much as 3 to 4% by total weight of product. Thus, a slightly higher linearity for the paraffin may be required in order to achieve a final desired linearity for the LAB product. If desired, the linear paraffin product may be further purified using molecular sieve separation techniques, which are commonly used when purifying LAB from petroleum-derived paraffins.

During alkylation, the aromatic group of the alkylaromatic compound may be attached to the alkyl chain at a mid or terminal chain position. Alkylation may be carried out using shape-selective catalyst to promote the attachment of the phenyl or other aromatic group to the alkyl chain at a desired position, such as the 2-phenyl position. Such catalysts are well known by those skilled in the art and include molecular sieve or zeolite catalyst, such as mordenite catalysts, ZSM-4, ZSM-12, offretite, gmelinite, etc. Thus, for example, alkylation may be carried out to promote attachment of the phenyl or aromatic group away from the monomethyl branch. In monomethyl isomers, the aromatic may be attached to a tertiary carbon atom, where the monomethyl branch is attached, to thus form a "quat." Mid-chain quat formation may result in poorer biodegradability properties, however, quat formation at the terminal or end chain position does not appear to alter biodegradability to a significant degree from linear alkylaromatics.

The alkylaromatics, including LAB, may be sulfonated using conventional sulfonating techniques that are well known to those skilled in the art. Examples include those described in *Detergent Manufacture Including Zeolite Builders and Other New Materials*, by Marshall Sittig, Noyes Data Corporation, Park Ridge, N.J., 1979 and in Volume 56 of "Surfactant Science" series, Marcel Dekker, Inc., New York, N.Y., 1996, herein incorporated by reference. Sulfonation of the arylalkane compounds produces a sulfonated product comprising arylalkane sulfonic acids. Common sulfonation systems employ sulfonating agents such as sulfuric acid, chlorosulfonic acid, oleum and sulfur trioxide. Sulfonation using a mixture of sulfur trioxide and air is described in U.S. Pat. No. 3,427,342, herein incorporated by reference.

Because of the predominantly terminal nature of monomethyl branching in the F-T n-paraffins, the sulfonates made from 94% linear F-T n-paraffins are biodegraded similarly to the current commercial sulfonates made from higher linearity mineral-based paraffins, which do not exhibit a dominance of terminal-branched molecules. Similarly, the sulfonates made from high 97%+ linear F-T n-paraffins are superior in biodegradability properties to the currently available commercial LAS because the remaining branched material is predominantly terminal-branched.

The isomeric side streams containing elevated amounts of the iso-paraffin also may have particular application in producing MLAS having increased hard-water solubility and cold-temperature detergency in both hard water and softer water, reduced Krafft temperature and similar biodegradability to LAS products. It is well known in the art, that branched hydrocarbon chains typically have better low-temperature properties, such as lower pour point, freeze point or congeal point. It is also known that monomethyl-branching, as opposed to long-chain branching or multi-methyl branching, while providing sufficient low-temperature benefits, decreases the length of a lipophilic surfactant tail less for the same carbon number hydrocarbon chain and therefore affords more surfactancy. Terminal or end-chain branched monomethyl isomer content of the F-T products is typically from about 20 to 70% by total weight of monomethyl isomers. The ratio of end-chain or terminal monomethyl branching to internal monomethyl branching may be from 1:1.5, 1:1, 1.5:1, 2:1 or more. End chain monomethyl isomers exhibit relatively high biodegradability compared to other branched isomers due to the relatively higher biodegradability of terminal quats versus internal quats, as is discussed above and in U.S. Pat. No. 6,187,981.

MLAS may exhibit increased hard-water solubility over linear sulfonates, as well as increased detergency in cold water. As used herein, "hard water" refers to water having an equivalent $CaCO_3$ content of greater than 200 ppm. The improved hard-water solubility and cold-temperature properties of MLAS was illustrated by comparing model compounds, one of which is a monomethyl-branched 5-Methyl-2-Phenyl Dodecyl Benzene Sulfonate, and the other is a linear 2-Phenyl Dodecyl Benzene Sulfonate. Krafft temperatures of a 1% solution of the sodium salt of the surfactants was measured. Also hard water solubility was measured at 25° C. by introducing into hard-water an amount of concentrated stock solution of the surfactant sufficient to achieve final concentration of 450 ppm of surfactant and 420 ppm hardness (3:1 $Ca^{++}$:$Mg^{++}$). As compared to the linear compound, monomethyl-branched sulphonate exhibits lower loss of surfactant in hard water (5% vs. 100%) and lower Krafft temperature (16° C. vs. 36° C.). MLAS, consisting of >95% terminal-phenyl (positions 2 and 3) and containing less than one methyl branch per chain, but otherwise similar in carbon number distribution to a sample of commercial LAS, lost 20% of its mass to filtration vs. 65% for the commercial (highly linear) LAS. Provided terminal-phenyl content of MLAS is sufficiently high, the detergency of 230 ppm of MLAS at 32° C. in both hard water and softer water (205 ppm hardness vs. 100 ppm hardness), when applied to a mixture of 54 consumer garments, proves to be superior to that of commercial LAS. This is discussed in "Improved Alkyl Benzene Surfactants: Molecular Design and Solution Physical Chemical Properties", T. Cripe, et al., The Procter & Gamble Company, herein incorporated by reference.

The invention is further illustrated by the following examples.

EXAMPLE 1

A pilot installation consisting of four hydrotreatment reactors containing a transition-metal impregnated catalyst and two distillation columns was used to produce a hydrotreated $C_{10-14}$ paraffin stream.

The reactors were fed approximately 3400 g/hr of liquid FT oil and 70 SCHF of combined fresh and recycle hydrogen for a space velocity of approximately 1. The FT oil, as well as the FT products of the other remaining examples, was produced from a FT reaction wherein syngas containing from about 10 to about 60% by volume nitrogen was fed to the FTR. The FT oil had approximately the following composition:

TABLE 2

| Carbon # | % by wt. |
|---|---|
| 4 | <0.1 |
| 5 | 0.01 |
| 6 | 0.3 |
| 7 | 1.0 |
| 8 | 2.9 |
| 9 | 5.9 |
| 10 | 8.1 |
| 11 | 9.2 |
| 12 | 9.5 |
| 13 | 9.2 |
| 14 | 8.4 |
| 15 | 7.9 |
| 16 | 7.1 |
| 17 | 6.2 |
| 18 | 5.4 |
| 19 | 4.6 |
| 20 | 3.7 |
| 21 | 3.0 |
| 22 | 2.3 |
| 23 | 1.7 |
| 24 | 1.2 |
| 25+ | 2.6 |
| Total | 100.000 |

The reactor conditions were 800 psig and 550 to 590° F. in 10° F. increments in consecutive reactors. Two distillation columns were used to produce a $C_{10}$ to $C_{14}$ paraffin stream. The lights removal column was operated at 2 psig, 480° F. bottoms temperature and 100° F. condenser temperature. The heavies column was operated at 100 mm Hg, 411° F. bottoms temperature 100° F. condenser temperature. The resulting stream had the characteristics as set forth in Table 3 below.

TABLE 3

| Carbon # Dist, wt % | wt % |
|---|---|
| $<C_9$ | 0.0% |
| $C_9$ | 0.0% |
| $C_{10}$ | 23% |
| $C_{11}$ | 30% |
| $C_{12}$ | 27% |
| $C_{13}$ | 20% |
| $C_{14}$ | 0.7% |
| $>C_{14}$ | 0.0% |
| $<C_{10}$ ($C_9$ & lighter) | 0.0% |
| $<C_{11}$ ($C_{10}$ & lighter) | 23% |

TABLE 3-continued

| Carbon # Dist, wt % | wt % |
|---|---|
| $C_{10} + C_{11}$ | 53% |
| $C_{13} + C_{14}$ | 21% |
| $>C_{13}$ ($C_{14}$ & heavier) | 0.7% |
| n-paraffins, wt % | 94% |
| Bromine Index (mg/100 g) | 5.0 |
| Color, Pt Co | +30 |
| Oxygenates, ppm GCMS | 105 |
| Total Iso-Normal Ratio | 0.6 |
| Weighted Iso-Norm Ratio | 0.6 |

EXAMPLE 2

A FT product similar to that of Example 1 was analyzed on a Hewlett Packard Series II gas chromatograph with 60 m RTX 1 column with 0.32 mm diameter and 3 micron film thickness. The resulting isomer breakdown is illustrated in Table 4.

TABLE 4

| Component | Wt. % |
|---|---|
| $NC_{9-}$ | 0.02 |
| 2 + 3 $MMC_{10}$ | 0.20 |
| 4+ $MMC_{10}$ | 0.03 |
| $NC_{10}$ | 22.22 |
| 2 + 3 $MMC_{11}$ | 1.19 |
| 4+ $MMC_{11}$ | 0.42 |
| $NC_{11}$ | 27.93 |
| 2 + 3 $MMC_{12}$ | 1.09 |
| 4+ $MMC_{12}$ | 0.50 |
| $NC_{12}$ | 24.96 |
| 2 + 3 $MMC_{13}$ | 0.92 |
| 4+ $MMC_{13}$ | 0.48 |
| $NC_{13}$ | 18.99 |
| 2 + 3 $MMC_{14}$ | 0.11 |
| 4+ $MMC_{14}$ | 0.13 |
| $NC_{14}$ | 0.41 |
| Total N | 94.54 |
| Total 2 + 3 MM | 3.51 |
| Total 4+ MM | 1.55 |
| Total N + MM | 99.61 |
| Others | 0.39 |

EXAMPLE 3

A hydrotreated composition of FT liquid similar to that in Example 1 was used as an input to an AEA Technologies' HYPROTECH HYSYS process simulation software.

The physical property data for the $C_{10}$-$C_{14}$ monomethyl-branched isomers was derived using the simulation's property estimation utility with normal boiling points, densities and critical constants as inputs. The simulation included three sequential distillations. The first distillation tower was simulated at approximately 30 psia with 585° F. reboiler temperature, 300° F. condenser temperature and 60 theoretical stages. Feed was charged into the $24^{th}$ stage from the bottom. In addition to predominantly $C_{10-}$ and $C_{14+}$ product being removed as the overhead and bottoms streams, respectively, a liquid sidestream was removed from stage 42. The simulation was run such that the overhead stream contained the majority of isomeric $C_{10}$ and bottoms stream contained the majority of $C_{14}$ branched isomers. The liquid sidestream was routed to a sidestripper for additional purification.

After the sidestripper, $C_{10}$-$C_{13}$ product was distilled in an isomeric distillation tower, operating at about 25 psia, 371°

F. condenser temperature and 463° F. reboiler temperature. The tower was simulated with 75 stages, with feed introduced at stage 25 from the bottom and a stream containing approximately 50% $C_{11}$ monomethyl isomers, approximately 30% n-decane and approximately 20% $C_{11}$ n-paraffins was removed from the $65^{th}$ stage. The overhead stream was composed of primarily n-decane and the bottoms primarily of n-$C_{11}$ through n-$C_{13}$. The bottoms was fed to the second tower. The second isomeric tower is also of 75 theoretical stages, with feed coming in on the $25^{th}$ stage, and sidestream product being removed at the $65^{th}$ stage. The tower was simulated at 25 psia with 490° F. reboiler temperature and 410° F. condenser temperature. The overhead product was primarily n-$C_{11}$. The bottoms product was n-$C_{12+}$. The overhead products from both isomeric distillation towers and the bottoms product from the last isomeric distillation tower were combined as the high linearity product having the composition as set forth in Table 5 below.

TABLE 5

| Component | Wt. % |
|---|---|
| $NC_9$ | 0.03 |
| $MMC_{10}$ | 0.10 |
| $NC_{10}$ | 8.63 |
| $MMC_{11}$ | 0.09 |
| $NC_{11}$ | 30.30 |
| $MMC_{12}$ | 0.22 |
| $NC_{12}$ | 31.58 |
| $MMC_{13}$ | 1.81 |
| $NC_{13}$ | 26.84 |
| $MMC_{14}$ | 0.09 |
| $NC_{14}$ | 0.02 |
| Total N | 97.39 |
| Total MM | 2.31 |
| Total N + MM | 99.70 |

EXAMPLE 4

Three hydrotreated $C_{10}$ to $C_{13}$ n-paraffin samples from FT products were analyzed to determine residual oxygenates. The samples had oxygenates as presented in Table 6 below.

TABLE 6

| Hydrotreated $C_{10}$—$C_{13}$ Oxygenates | | | |
|---|---|---|---|
| Gas Chromatography-Mass Spectrometry Analysis | Sample 1 (ppm by wt.) | Sample 2 (ppm by wt.) | Sample 3 (ppm by wt.) |
| 1-Nonanol | 1.6 | 12.1 | 3.6 |
| 2-Nonanol | <0.4 | 1.6 | 1.8 |
| 1-Decanol | 2.2 | 14.0 | 12.1 |
| 2-Decanol | 0.4 | 4.5 | 3.3 |
| 3-Decanol | <0.4 | <0.4 | 9.2 |
| 4-Decanol | 0.3 | 4.2 | 3.1 |
| Unk C10 alcohols | <0.4 | <0.4 | <0.4 |
| 1-Undecanol | 1.6 | 9.0 | 4.3 |
| 2-Undecanol | 1.4 | 4.5 | 3.9 |
| 3-Undecanol | 0.9 | 3.3 | 4.8 |
| 4-Undecanol | 0.6 | 2.1 | 5.2 |
| Unk C11 alcohols | 0.8 | 3.2 | 5.7 |
| 1-Dodecanol | 0.5 | 1.0 | 1.4 |
| 2-Dodecanol | 4.6 | 8.0 | <0.4 |
| Unk C12 alcohols | 6.0 | 15.3 | <1.0 |
| 1-Tridecanol | <0.4 | <0.4 | <0.4 |
| Unk C13 alcohols | 3.1 | 6.7 | <0.4 |
| 1-Tetradecanol | <0.4 | <0.4 | <0.4 |
| Unk C14 alcohols | 1.0 | 0.5 | <0.4 |
| 1-Octanal | 4.5 | 4.9 | 4.3 |
| 1-Nonanal | 4.2 | 6.7 | 7.7 |

TABLE 6-continued

| Hydrotreated $C_{10}$—$C_{13}$ Oxygenates | | | |
|---|---|---|---|
| Gas Chromatography-Mass Spectrometry Analysis | Sample 1 (ppm by wt.) | Sample 2 (ppm by wt.) | Sample 3 (ppm by wt.) |
| 1-Decanal | 3.9 | 8.3 | 16.9 |
| 1-Undecanal | 3.0 | 7.2 | 17.1 |
| 1-Dodecanal | <0.6 | 1.4 | <1.0 |
| 1-Tridecanal | <0.5 | <0.5 | <1.0 |
| 2-Heptanone | 0.7 | 1.6 | <0.4 |
| 2-Octanone | 1.5 | 3.8 | <0.4 |
| 2-Nonanone | 2.4 | 6.6 | 0.6 |
| 2-Decanone | 3.1 | 10.1 | 2.9 |
| 2-Undecanone | 3.3 | 11.3 | 3.5 |
| 2-Dodecanone | 1.6 | 5.7 | 1.0 |
| Unk C11 ketones | 2.2 | 1.0 | 5.2 |
| Unk C12 ketones | 1.3 | 5.4 | 6.1 |
| Butanoic Acid | 3.3 | 1.2 | 1.6 |
| Pentanoic Acid | 6.7 | 2.4 | 1.6 |
| Hexanoic Acid | 10.4 | 3.6 | 3.3 |
| Heptanoic Acid | 12.8 | 4.5 | 4.3 |
| Octanoic Acid | 14.3 | 4.7 | 6.7 |
| Nonanoic Acid | 16.0 | 5.3 | 9.4 |
| Decanoic Acid | 16.7 | 5.1 | 10.1 |
| Undecanoic Acid | 12.0 | 4.0 | 15.4 |
| Lauric Acid | 6.6 | 2.4 | 12.6 |
| Total | 155.5 | 197.2 | 188.7 |
| Total ROH | 25.0 | 90.0 | 58.4 |
| Total aldehydes | 15.6 | 28.5 | 46.0 |
| Total Ketones | 16.1 | 45.5 | 19.3 |
| Total acids | 98.8 | 33.2 | 65.0 |

EXAMPLE 5

From FT products, a hydrotreated $C_{10-13}$ n-paraffin feed was treated to remove residual oxygenates. The hydrotreated feed contained approximately 105 ppm by weight of feed. Twenty cc of HPG-429 adsorbent was packed into a 7.5 mm ID×5.5' reactor with approximately 50 cc of glass beads serving as feed distributors below and above the bed. The adsorbent bed was kept in a hot box to maintain 40° C. temperature during adsorption. The hydrotreated $C_{10-13}$ n-paraffin feed containing the residual oxygenates was charged to the adsorbent bed. The effluent of the adsorbent bed was analyzed via GCMS for traces of remaining oxygenates at different times. The GCMS method used was: GC-HP5890 equipped with a split capillary injector; Columns: 1) J&W DB-wax 30 m×0.25 mm×0.25 μm, 2) Restek Rtx-5 30 m×0.25 mm×0.25 μm. MS-HP5970A Mass Selective Detector, Interface: Fabricated open-split interface, Data Acquisition.: HP Chemstation data acquisition system utilizing HP Vectra XA computer. The results are shown in Table 7, demonstrating absence of oxygenated species in the effluent in the initial samples, followed by breakthrough. All values are ppm by weight of feed.

TABLE 7

| | | Product | |
|---|---|---|---|
| Compound | Feed Analysis | Before Breakthrough 2 | After Breakthrough 12 |
| 1-Nonanol | <0.4 | ≦1.2 | ≦0.9 |
| 2-Nonanol | 0.6 | <0.4 | <0.4 |
| 1-Decanol | <0.4 | <0.4 | <0.4 |
| 2-Decanol | 1.2 | <0.4 | <0.4 |
| 3-Decanol | 0.6 | <0.4 | <0.4 |

TABLE 7-continued

| Compound | Feed Analysis | Product: Before Breakthrough 2 | Product: After Breakthrough 12 |
|---|---|---|---|
| 4-Decanol | 1.1 | <0.4 | <0.4 |
| 1-Undecanol | <0.4 | <0.4 | <0.4 |
| 2-Undecanol | 0.8 | <0.4 | <0.4 |
| 3-Undecanol | 0.6 | <0.4 | <0.4 |
| 1-Dodecanol | <0.4 | <0.4 | <0.4 |
| 2-Dodecanol | 0.6 | <0.4 | <0.4 |
| 1-Tridecanol | 0.6 | <0.4 | <0.4 |
| 1-Tetradecanol | 1.3 | <0.4 | <0.4 |
| Octanal | <0.4 | <0.4 | <0.4 |
| Nonanal | 1.5 | <0.4 | 1.3–1.8 |
| Decanal | 1.4 | <0.4 | 1.2–1.7 |
| Undecanal | 2.1 | <0.4 | 0.6–1.4 |
| Dodecanal | 1.2 | <0.4 | ≦1.0 |
| Tridecanal | <0.4 | <0.4 | <0.4 |
| 2-Hexanone | 2.4 | <0.4 | <0.4 |
| 2-Heptanone | 0.4 | <0.4 | <0.4 |
| 2-Octanone | 0.5 | <0.4 | <0.4 |
| 2-Nonanone | 1.4 | <0.4 | 0.5–0.9 |
| 2-Decanone | 1.8 | <0.4 | 1.5–2.4 |
| 2-Undecanone | 2.0 | ≦0.4 | 2.1–2.5 |
| 6-Undecanone | 1.0 | <0.4 | 1.0–1.3 |
| Formic Acid | 12.7 | <1.0 | <1.0 |
| Acetic Acid | 16.7 | <1.0 | <1.0 |
| Propanoic Acid | 4.7 | <1.0 | <1.0 |
| Butanoic Acid | 8.3 | <1.0 | ≦1.3 |
| Pentanoic Acid | 9.1 | <1.0 | ≦1.5 |
| Hexanoic Acid | 4.5 | <1.0 | ≦1.1 |
| Heptanoic Acid | 2.5 | <1.0 | <1.0 |
| Octanoic Acid | 2.3 | <1.0 | <1.0 |
| Nonanoic Acid | 2.5 | ≦1.0 | ≦1.1 |
| Decanoic Acid | 2.6 | ≦1.1 | <1.0 |
| Undecanoic Acid | 2.8 | ≦2.0 | <1.0 |
| Dodecanoic Acid | 2.5 | ≦2.0 | ≦1.9 |
| Tridecanoic Acid | 2.3 | <1.0 | <1.0 |
| Tetradecanoic Acid | 2.4 | <1.0 | <1.0 |
| Unknown $C_4H_6O_2$ | 7.1 | <1.0 | <1.0 |
| Total | 105.9 | <1.0–6.1 | 11.0–20.6 |

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

I claim:

1. A method of forming a hydrocarbon product consisting of:

converting synthesis gas in a Fischer-Tropsch reaction to hydrocarbon products;

hydrotreating the hydrocarbon products to provide hydrotreated hydrocarbon products, the hydrotreated hydrocarbon products having an n-paraffin content of at least 50% by weight of the hydrotreated hydrocarbon products and branched paraffins, wherein the ratio of end-chain monomethyl branching to internal branching of the monomethyl branched paraffins is at least about 1:1.

2. A method of forming a hydrocarbon product consisting of:

converting synthesis gas in a Fischer-Tropsch reaction to hydrocarbon products;

hydrotreating the hydrocarbon products to provide hydrotreated hydrocarbon products, the hydrotreated hydrocarbon products having an n-paraffin content of at least 50% by weight of the hydrotreated hydrocarbon products and branched paraffins, wherein the ratio of end-chain monomethyl branching to internal branching of the monomethyl branched paraffins is at least about 2:1.

3. A method of forming a hydrocarbon product consisting of:

converting synthesis gas in a Fischer-Tropsch reaction to hydrocarbon products;

hydrotreating the hydrocarbon products to provide hydrotreated hydrocarbon products, the hydrotreated hydrocarbon products having an initial n-paraffin content of greater than about 67% by weight of the hydrotreated hydrocarbon products and having branched paraffins;

separating at least a portion of at least one non-linear branched paraffin isomer from the hydrocarbon products through distillation to provide an n-paraffin product having an n-paraffin content percentage by weight of the n-paraffin product that is greater than the initial n-paraffin content; and isolating $C_8$ to $C_{24}$ hydrocarbon products from the hydrocarbon products; and wherein the initial n-paraffin content is the initial n-paraffin content of the $C_8$ to $C_{24}$ hydrocarbon products.

4. The method of claim 3, wherein the $C_8$ to $C_{24}$ hydrocarbon products are $C_{10}$ to $C_{14}$ hydrocarbon products.

5. A method of forming a hydrocarbon product consisting of:

converting synthesis gas in a Fischer-Tropsch reaction to hydrocarbon products;

hydrotreating the hydrocarbon products to provide hydrotreated hydrocarbon products, the hydrotreated hydrocarbon products having an initial n-paraffin content of greater than about 67% by weight of the hydrotreated hydrocarbon products and having branched paraffins; and separating at least a portion of at least one non-linear branched paraffin isomer from the hydrocarbon products through distillation to provide an n-paraffin product having an n-paraffin content percentage by weight of the n-paraffin product that is greater than the initial n-paraffin content, wherein the hydrotreated hydrocarbon products have an initial monomethyl branched paraffin content of greater than about 2% by weight of the hydrotreated hydrocarbon products without employing non-distillation separation techniques, wherein separating at least a portion of at least one non-linear branched paraffin isomer includes separating at least one monomethyl branched paraffin isomer from the hydrocarbon products, wherein separating the at least one monomethyl branched paraffin isomer includes separating a monomethyl fraction containing the at least one monomethyl branched paraffin isomer, and wherein the monomethyl fraction contains the at least one monomethyl branched paraffin isomer in an amount of at least 20% by weight of the monomethyl fraction.

6. A method of forming a hydrocarbon product consisting of:

converting synthesis gas in a Fischer-Tropsch reaction to hydrocarbon products;

hydrotreating the hydrocarbon products to provide hydrotreated hydrocarbon products, the hydrotreated hydrocarbon products having an initial n-paraffin content of greater than about 67% by weight of the hydrotreated hydrocarbon products and having branched paraffins; and separating at least a portion of at least one non-linear branched paraffin isomer from the hydrocarbon products through distillation to provide an n-paraffin product having an n-paraffin content percentage by weight of the n-paraffin product that is greater than the initial n-paraffin content, wherein the hydrotreated hydrocarbon products have an initial inonomethyl branched paraffin content of greater than about 2% by weight of the hydrotreated hydrocarbon products without employing non-distillation separation techniques, wherein separating at least a portion of at least one non-linear branched paraffin isomer includes separating at least one monomethyl branched paraffin isomer from the hydrocarbon products, and wherein at least 50% by weight of the monomethyl branched paraffins are end-chain monomethyl branched paraffins.

7. A method of forming a hydrocarbon product consisting of:

converting synthesis gas in a Fischer-Tropsch reaction to hydrocarbon products;

hydrotreating the hydrocarbon products to provide hydrotreated hydrocarbon products, the hydrotreated hydrocarbon products having an initial n-paraffin content of greater than about 67% by weight of the hydrotreated hydrocarbon products and having branched paraffins; and separating at least a portion of at least one non-linear branched paraffin isomer from the hydrocarbon products through distillation to provide an n-paraffin product having an n-paraffin content percentage by weight of the n-paraffin product that is greater than the initial n-paraffin content, wherein the hydrotreated hydrocarbon products have an initial monomethyl branched paraffin content of greater than about 2% by weight of the hydrotreated hydrocarbon products without employing non-distillation separation techniques, wherein separating at least a portion of at least one non-linear branched paraffin isomer includes separating at least one monomethyl branched paraffin isomer from the hydrocarbon products, wherein at least 67% by weight of the monomethyl branched paraffins are end-chain monomethyl branched paraffins.

8. A method of forming hydrocarbon products consisting of:

converting synthesis gas in a Fischer-Tropsch reaction to hydrocarbon F-T reaction products;

hydrotreating the hydrocarbon F-T reaction products to form hydrocarbon products;

isolating $C_8$ to $C_{24}$ hydrocarbons from the hydrocarbon products, the $C_8$ to $C_{24}$ hydrocarbons having an initial n-paraffin content greater than about 92% by weight of the hydrotreated hydrocarbon products and having an initial monomethyl branched paraffin content of greater than about 2% by weight of the $C_8$ to $C_{24}$ hydrocarbon products; and separating at least a portion of at least one monomethyl branched paraffin isomer from the $C_8$ to $C_{24}$ hydrocarbon products through distillation to provide an n-paraffin product having an n-paraffin content percentage by weight of the n-paraffin product that is greater than the initial n-paraffin content, wherein separating the at least one monomethyl branched paraffin isomer includes separating a monomethyl fraction containing the at least one monomethyl branched paraffin isomer, and wherein the monomethyl fraction contains the at least one monomethyl branched paraffin isomer in an amount of at least 20% by weight of the monomethyl fraction.

9. A method of forming hydrocarbon products consisting of:

converting synthesis gas in a Fischer-Tropsch reaction to hydrocarbon F-T reaction products;

hydrotreating the hydrocarbon F-T reaction products to form hydrocarbon products:

isolating $C_8$ to $C_{24}$ hydrocarbons from the hydrocarbon products, the $C_8$ to $C_{24}$ hydrocarbons having an initial n-paraffin content greater than about 92% by weight of the hydrotreated hydrocarbon products and having an initial monomethyl branched paraffin content of greater than about 2% by weight of the $C_8$ to $C_{24}$ hydrocarbon products; and separating at least a portion of at least one monomethyl branched paraffin isomer from the $C_8$ to $C_{24}$ hydrocarbon products through distillation to provide an n-paraffin product having an n-paraffin content percentage by weight of the n-paraffin product that is greater than the initial n-paraffin content, wherein at least 40% by weight of the monomethyl branched paraffins are end-chain monomethyl branched paraffins.

10. A method of forming hydrocarbon products consisting of: converting synthesis gas in a Fischer-Tropsch reaction to hydrocarbon F-T reaction products;

hydrotreating the hydrocarbon F-T reaction products to form hydrocarbon products:

isolating $C_{8\ to\ C24}$ hydrocarbons from the hydrocarbon products, the $C_8$ to $C_8$ to $C_{24}$ hydrocarbons having an initial n-paraffin content greater than about 92% by weight of the hydrotreated hydrocarbon products and having an initial monomethyl branched paraffin content of greater than about 2% by weight of the $C_8$ to $C_{24}$ hydrocarbon products; and separating at least a portion of at least one monomethyl branched paraffin isomer from the $C_8$ to $C_{24}$ hydrocarbon products through distillation to provide an n-paraffin product having an n-paraffin content percentage by weight of the n-paraffin product that is greater than the initial n-paraffin content, wherein at least 67% by weight of the monomethyl branched paraffins are end-chain monomethyl branched paraffins.

11. A method of forming a hydrocarbon product consisting of:

converting synthesis gas in a Fischer-Tropsch reaction to hydrocarbon products; and hydrotreating at least a portion of the hydrocarbon products to provide hydrotreated hydrocarbon products; and removing oxygenates from the hydrotreated hydrocarbon products by passing the hydrotreated hydrocarbon products over at least one of an alumina, silica or alumina-silica molecular sieve adsorbent so that the hydrotreated hydrocarbon products contain less than 20 ppm by weight of oxygenates, wherein the hydrotreated hydrocarbon products contain from 50 to 500 ppm by weight oxygenates prior to the removal of oxygenates, and wherein the hydrotreated hydrocarbon products include at least one of chemical naphtha for ethylene cracking in the $C_8$ to $C_8$ range, fuel cell feedstocks in the $C_4$-$C_8$ range, normal paraffin compounds in the $C_5$-$C_{30}$ range, isoparaffin compounds in the $C_5$-$C_{30}$ range, normal paraffin and isoparaffin drilling fluids in the $C_8$-$C_{25}$ range, lubricating fluids in the $C_5$-$C_{30}$ range, drilling fluids in the $C_5$-$C_{30}$ range, food grade solvents in the $C_5$-$C_{60}$ range, base oils in the $C_5$-$C_{60}$ range, solvents in the $C_5$-$C_{60}$ range, oils in the $C_5$-$C_{60}$ range, and functional fluids in the $C_5$-$C_{60}$ range.

* * * * *